United States Patent [19]

Temple et al.

[11] 4,310,783

[45] Jan. 12, 1982

[54] CATHODE RAY TUBE FACE PLATE CONSTRUCTION FOR SUPPRESSING THE HALO HAVING A LOW REFLECTION AND METHOD

[76] Inventors: Michael D. Temple, 1520 Sunview Ct., Santa Rosa, Calif. 95401; James D. Rancourt, 129 Sherwood Dr., Santa Rosa, Calif. 95405; Erik W. Anthon, 1487 Manzanita Ave., Santa Rosa, Calif. 95404

[21] Appl. No.: 36,495

[22] Filed: May 7, 1979

[51] Int. Cl.[3] ..... H01J 29/28; H01J 29/89

[52] U.S. Cl. ..... 313/474; 313/478

[58] Field of Search ..... 313/462, 466, 474, 478, 313/477, 479

[56] References Cited

U.S. PATENT DOCUMENTS

| | | | |
|---|---|---|---|
| 2,476,619 | 7/1949 | Nicoll | 313/474 X |
| 2,599,739 | 6/1952 | Barnes | 313/478 X |
| 2,676,109 | 4/1954 | Barnes et al. | 313/477 X |
| 3,185,020 | 5/1965 | Thelen . | |
| 3,504,212 | 3/1970 | Wollentin et al. | 313/474 |
| 3,573,529 | 4/1971 | Tomii | 313/478 |

*Primary Examiner*—Palmer C. Demeo

*Attorney, Agent, or Firm*—Flehr, Hohbach, Test, Albritton & Herbert

[57] ABSTRACT

A cathode ray tube face plate construction for suppressing the halo on the face plate of the cathode ray tube having a face plate formed of glass with an index of refraction in the vicinity of 1.52 and with outer and inner surfaces. A fluorescent phosphor screen is carried by the inner surface. A metallic coating may overlie the phosphor screen on the side of the screen facing away from the face plate. An absorbing filter is disposed between the phosphor screen and the face plate for absorbing light emitted from the phosphor screen. An angle sensitive short wave pass filter is disposed between the phosphor screen and the absorbing filter for reflecting light emitted at a high angle from the phosphor screen.

15 Claims, 6 Drawing Figures

CATHODE RAY TUBE FACE PLATE CONSTRUCTION FOR SUPPRESSING THE HALO HAVING A LOW REFLECTION AND METHOD

This invention relates to a cathode ray tube face plate construction for suppressing the halo having a low reflectance and method and more particularly to such a construction and method which utilizes an absorbing filter.

In copending application, Ser. No. 036,324, filed May 7, 1980, there is disclosed a cathode ray tube face plate construction in which an angle sensitive coating is utilized for suppressing the halo. As disclosed therein, the halo suppressing filter is a shortwave pass type which has a very steep slope near the band of wavelengths that are emitted by the phosphor on the face plate. At normal incidence, the filter has a region of high transmission over the range of wavelengths where the phosphor is strongly emitting. At the wavelength which is just beyond the long wavelength limit of the emission band, there is a steep transition to a high reflection region. When such an interference filter is formed of all dielectrics, the performance curve for the filter will shift to shorter wavelengths as the angle of incidence of light is increased away from normal. For high angle of incidence light from the phosphor, the rays will be incident in the region of the performance curve where the filter reflects well and they will be prevented from entering the face plate. In order to obtain a sharp transition between reflecting and transmitting regions of the filter, many layers are required in such a filter which makes the filter prone to coating errors and, therefore, difficult to manufacture. In addition, it has been found that such an all dielectric filter has a reflectance which is independent of the direction from which the light is incident. Since it is desired that such a filter have a large reflectance at moderate and higher angles of incidence from the phosphor side, it follows that such a filter will also be highly reflecting when viewed by an observer looking at the display through the substrate. When the phosphor screen is viewed in a brightly lit room, the display will be difficult to observe and the reflections of the room and from the observer himself will be very distracting. In the past, attempts have been made to reduce such reflections by the use of a circular polarizing filter in front of the screen. The use of such a circular polarizing filter has the limitation in that there is an upper limit on the transmission that can be obtained. Due to the nature of such circular polarizing filters, generally no more than 40% of the incident light can be transmitted through it. Where the optimum transmission required is less than this amount, additional neutral density filters can be included to obtain the desired level of transmission. However, on the other hand, if the optimum level of transmission required is greater than the 40% which can be obtained through such a circular polarizing filter, the use of a circular polarizing filter must be abandoned. In addition, the cost and environmental stability of circular polarizing filters also limit their applications. Another alternative has been to utilize a cyan or shortwave pass absorbing filter in the front of the face plate of the cathode ray tube. In such a situation, at least the front surface of the filter should be provided with antireflection coating in order to maintain the signal to noise ratio. This becomes particularly important in a brightly lit room where the reflections by the separate absorbing filter of the surrounding scene increase the difficulty with which the display can be seen. Another disadvantage of such an approach is that the separate filter reduces the visibility of the graticule conventionally carried by the screen of the cathode ray tube. In addition, it should be appreciated that the use of such a separate absorbing filter reduces the halo and the signal illumination from the screen in the same proportions and does not reduce the halo selectively.

Another alternative, the use of absorbing glass in the face plate of the cathode ray for reducing the halo effect, also has disadvantages. This approach also is not practical in many situations because the graticule on the interior surface of the face plate is illuminated from the edge of the screen and any absorption produces a nonuniform illumination of the graticule as a function of position on the screen. Furthermore, any scattering in the absorbing glass would strongly affect the visibility of the display. In addition, conventional absorbing glass which can be utilized in such a face plate has the disadvantage that it does not have a high enough density to suppress the soft x-ray emission which may be generated by the electron gun in the cathode ray tube. It is, therefore, apparent that there is a need for a new and improved face plate construction for a cathode ray tube and a method for suppressing the halo.

In general, it is an object of the present invention to provide a cathode ray tube face plate construction having a low reflection and method for suppressing the halo.

Another object of the invention is to provide a construction and method of the above character in which an absorbing filter is combined with a shortwave pass filter in the construction of a face plate.

Another object of the invention is to provide a construction and method of the above character in which an absorbing low reflectance coating is combined with a shortwave pass filter that is angle sensitive to provide low observer side reflectance and high phosphor side reflectance.

Another object of the invention is to provide a construction and method of the above character in which the value of transmission can be selected arbitrarily.

Another object of the invention is to provide a construction and method of the above character in which the reflectance from the observer's side is essentially independent of the reflectance on the other side of the filter.

Another object of the invention is to provide a construction and method of the above character in which the reflectance from the observer's side can be relatively low while that from the phosphor side can be quite high and angle sensitive.

Another object of the invention is to provide a construction and method of the above character in which there is unrestricted viewing of the graticule carried by the face plate.

Another object of the invention is to provide a construction and method of the above character in which the graticule can be edge-lighted uniformly over the entire surface area.

Another object of the invention is to provide a construction and method of the above character in which the filters are provided within the cathode ray tube envelope and are thus immune to optical degradation and from scratching which otherwise could occur because of mishandling and improper cleaning.

Another object of the invention is to provide a construction and method of the above character which selectively attenuates the halo.

Another object of the invention is to provide a construction and method of the above character in which an anti-reflection coating is carried by the observer's side or first surface side of the face plate.

Another object of the invention is to provide a construction and method of the above character in which the background color of the screen can be adjusted to provide a pleasing tint or to enhance the color contrast of the display.

Another object of the invention is to provide a construction and method of the above character in which the low level of reflectance of the second surface of the face plate makes the quality of the first surface anti-reflection coating less critical.

Another object of the invention is to provide a construction and method of the above character in which the use of an absorbing filter without a shortwave pass filter can be utilized in certain applications.

Additional objects and features of the invention will appear from the following description in which the preferred embodiments are set forth in detail in conjunction with the accompanying drawings.

The face plate construction for the cathode ray tube is comprised of a sheet of glass having front and rear surfaces. An absorbing filter is carried by the rear surface. A phosphor screen overlies the absorbing filter and an optional metallic coating may overlie the phosphor screen. The absorbing filter is comprised of at least two layers with one of the layers being formed of a dielectric and the other of the two layers being formed of metal. The absorbing filter can be utilized in combination with an angle sensitive shortwave pass filter and in which the shortwave pass filter is disposed between the absorbing filter and the phosphor screen.

Figure 1:
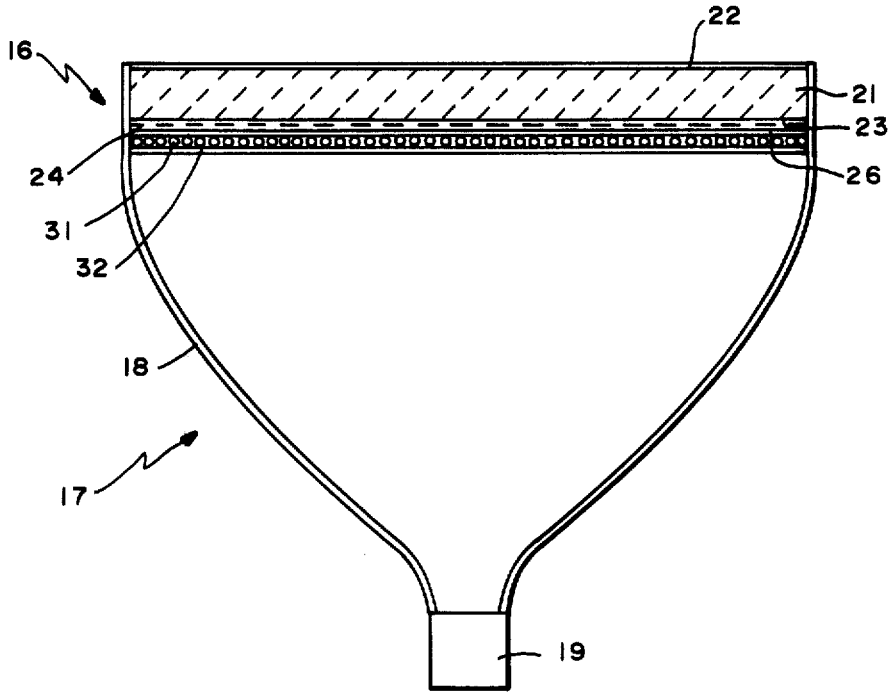
FIG. 1 is a cross sectional view of a cathode ray tube and a face plate construction incorporating the present invention and utilizing only an absorbing filter.

A face plate construction 16 incorporating the present invention for use on a cathode ray tube 17 carried the cathode ray tube 17 with the exception of the face plate 16 is conventional and as is well known to those skilled in the art, it is comprised of a funnel 18 formed of conventional material such as glass on which there is mounted an electron gun 19. The electron gun 19 produces electrons which are adapted to impinge upon the back or rear side of the face plate 16 as is well known to those skilled in the art to produce a display.

The face plate construction 16 consists of a face plate 21 formed of a sheet or pane of glass of a conventional type having an index of refraction in the range 1.45 to 1.75 and may have a high density. The face plate 21 is provided with first and second or front and rear generally planar parallel surfaces 22 and 23 which also can be identified as observer's side and phosphor side surfaces. A graticule 24 is typically placed on the inner or second surface 23 in the conventional manner such as by silk screening a glass frit material onto the rear side of the sheet 11 and firing it to fuse the graticule onto the sheet.

After the graticule has been placed upon the surface 23, an absorbing filter is placed over the graticule by placing the face plate in a vacuum chamber and vacuum depositing the desired layers for an absorbing filter 26 over the graticule so that the absorbing filter 26 overlies the graticule 24 and is carried by surface 23.

The absorbing filter 26 is a metal and dielectric structure and is comprised of at least two layers, one of the layers being a metal layer and the other layer being a dielectric layer to form a period. Additional periods of one dielectric layer and one metal layer can be provided to provide a multi-layer absorbing filter having a plurality of periods.

In selecting materials to be utilized in the absorbing filter 26, certain criteria should be observed. By definition, the index of refraction of an absorbing material has an imaginary component (k). The ratio of the real component (n) to (k) should be k/n equal to approximately 0.7 to 3.0. Examples of materials which fall in this class are nickel, chrome a nickel chrome alloy sold under the trademark, Nichrome, molybdenum and a nickel, chrome and iron alloy sold under the trademark Inconel.

The choice of the dielectric component for the absorbing filter 26 is based on design considerations which provide a low reflectance from the observer side of the filter. At the same time, design consideration can be given towards achieving a particular tint or hue for visibility or other reasons as well. Thus, any transparent dielectric material can be utilized, but preferably those with indices between 1.35 and 1.70. The specific metal and the specific dielectric material selected for the combination in the absorbing filter 26 are determined by the criteria which must be met. For example, the nominal transmission and reflection values for the filter are selected for use in the environment in which the filter is to be used and which it must be able to withstand. Once these parameters have been specified, one skilled in the design of thin film filters working within the guidelines herein presented should have no difficulty in selecting appropriate materials and their respective thicknesses for the design of an appropriate absorbing filter.

In Tables I and II set forth below there are two filter designs which include a shortwave pass filter plus an absorbing filter.

TABLE I

| Layer | 35% Nominal Material Glass | Physical Thickness (nm) |
|---|---|---|
| 1 | Ni | 4.5 |
| 2 | F.S. | 94.28 |
| 3 | Ni | 8.3 |
| 4 | F.S. | 94.28 |
| 5 | $TiO_2$ | 62.22 |
| 6 | F.S. | 161.13 |
| 7 | $TiO_2$ | 52.73 |
| 8 | F.S. | 144.34 |
| 9 | $TiO_2$ | 62.33 |
| 10 | F.S. | 63.60 |

TABLE II

| Layer | 50% T Nominal Material Glass | Physical Thickness (nm) |
|---|---|---|
| 1 | Mo | 7.5 |
| 2 | F.S. | 93.77 |
| 3 | $TiO_2$ | 58.66 |
| 4 | F.S. | 157.54 |
| 5 | $TiO_2$ | 58.01 |
| 6 | F.S. | 144.68 |
| 7 | $TiO_2$ | 67.61 |
| 8 | F.S. | 75.77 |
| | Air | |

Figure 3:
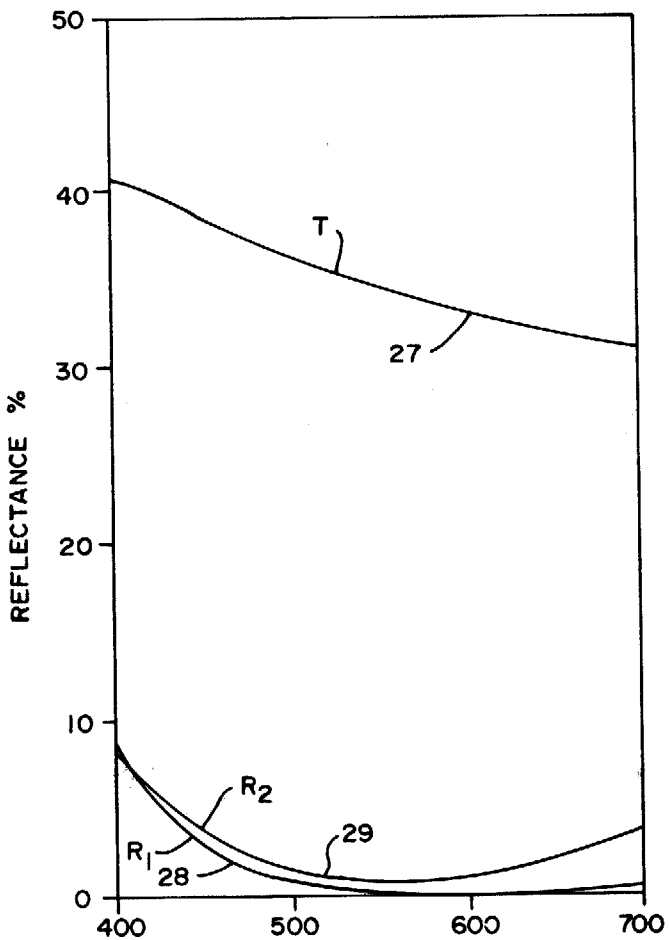
FIG. 3 is a calculated performance of an absorbing filter.

The design shown in Table I is for 35% nominal transmission and the filter design shown in Table II is for 50% nominal transmission. In Table I, the first four layers, namely layers 1 through 4 counting from the glass, form an absorbing filter whose performance is shown in FIG. 3. Curve 27 in FIG. 3 shows the transmission for the absorbing filter and as can be seen from the graph shows a nominal transmission of approximately 35%. Curves 28 and 29 which are also labeled as R1 and R2 show the reflectance from the observer or outer side and the phosphor or inner side respectively for the absorbing filter formed by the first four layers 1 through 4 in Table I.

After the absorbing filter 26 has been formed on the surface 23, a fluorescent phosphor screen 31 is deposited on the surface 23 so it overlies the absorbing filter 26 in a manner well known to those skilled in the art. Thereafter, an optional metallic coating such as aluminum may be deposited on the side of the screen 31 facing away from the surface 23 for a purpose well known to those skilled in the art as described in copending application, Ser. No. 036,324, filed May 7, 1979.

In the use of such an absorbing filter in connection with the face plate, it is desirable that the reflectance be less than a 10% maximum throughout the visible region. As will be noted from FIG. 3, the maximum reflectance is in the vicinity of 3 or 4 percent in the visible region for a design of the type shown in Table I. In general it is desirable to have the reflectance from the observer side be in the same order of magnitude as uncoated glass and even lower, if possible. Typically, uncoated glass with an index of refraction of 1.52 has a reflection of about 4¼% per surface.

It should, however, be appreciated that if desired, an absorbing filter having different characteristics can be utilized, if desired. Thus, the characteristics should be such that the reflection would correspond to that desired. For example, in suggesting that the reflectance be between 3% and 4% in the visible region viewing by the human eye is contemplated. If the cathode ray tube is to be viewed by film having the particular characteristics, then the coating which is utilized should be one which corresponds to the characteristics desired by the film which is to be used.

Although the absorbing filter shown by the design in Table I had a nominal transmission of approximately 35%, it should be appreciated that absorbing filters can be provided having a transmission ranging from 10 to 80%. The metal layer or layers provide the absorption which is necessary to obtain the desired transmission whereas the dielectric layer essentially anti-reflects the metal and prevents the normal specular reflection of the metal. As can be seen, the metal layer is deposited first and then the dielectric layer. In the design shown in Table I, nickel has been utilized as metal and fused silica having an index of refraction of approximately 1.45 has been utilized.

In Table II, there is shown a filter in which the first two layers 1 and 2 form an absorbing filter of the present invention and provide approximately 50% nominal transmission. In this design, molybdenum was used as the metal layer and fused silica as the dielectric one.

If desired, an anti-reflection coating 22 such as that described in U.S. Pat. No. 3,185,020 can be applied to the first front or outer surface of the sheet 21.

The use of the absorbing filter in the face plate construction provides a relatively economical solution for reducing the halo. This is because the light which forms the halo must pass through the absorbing filter three times so that there is much more attenuation of the halo producing light than of the signal light which only must pass once through the absorbing filter. Thus there is provided a greatly increased contrast and much improved visibility of the signal which is to be observed.

As pointed out in copending application, Ser. No. 036,324 filed May 7, 1979, the halo producing light is the light which is emitted from the phosphor grains at quite high angles to the normal and typically would pass through the absorbing filter, then through the face plate to be reflected off the front surface of the face plate and returned through the absorbing filter where it would illuminate the phosphor grains to cause scattering. Any such scattered light visible to the observer would have passed through the absorbing material three times to greatly attenuate the halo producing light. The normal signal light which would be seen by the observer would only have to make one pass through the absorbing filter.

In the embodiment of the invention shown in FIG. 1, the halo is attenuated strictly by absorption. This approach has a disadvantage in that in order to substantially attenuate the halo, it is necessary to have a density level which is relatively high; this may be objectionable where the amount of light given off by the display may be inadequate after such substantial absorption. When such is the case, it is desirable to combine the absorption filter with an angle sensitive short wave pass filter as shown in the embodiment in FIG. 2.

Figure 2:
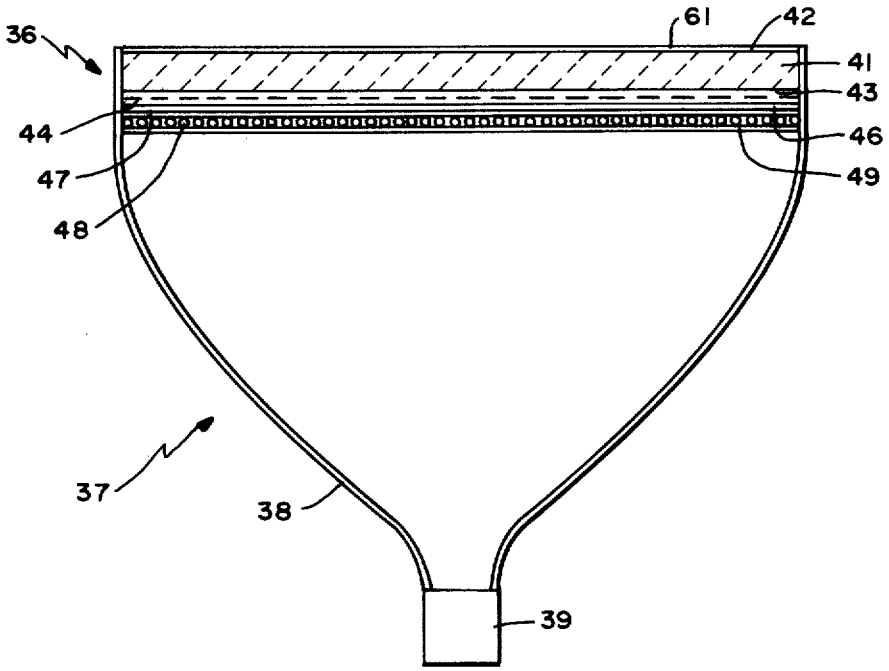
FIG. 2 is a cross sectional view of another cathode ray tube having a face plate construction incorporating the present invention in which an angle sensitive shortwave pass filter is utilized in conjunction with an absorbing filter.

As shown in FIG. 2, the face plate construction 36 forms a part of a cathode ray tube 37 having a funnel 38 and electron gun 39. The face plate construction 36 consists of a face plate 41 formed of clear glass and which is provided with parallel first and second surfaces 42 and 43. The first and second surfaces 42 and 43 can also be characterized as outer or observer and inner or phosphor side surfaces respectively. A graticule 44 is formed on the surface 43 in the same manner as the graticule 24. An absorbing filter 46 is carried by the second surface 43 and overlies the graticule 44. The absorbing filter 46 is combined with an angle sensitive short wave pass filter 47 of the type described in copending application, Ser. No. 036,324, filed May 7, 1979. This angle sensitive short wave pass filter overlies the absorbing filter 46. As described in the said co-pending application, Ser. No. 036,324, filed May 7, 1979, the angle sensitive short wave pass filter is an interference filter comprised of a plurality of layers and having a low reflectance for light emitted by the phosphor at high angles of incidence and a high reflectance for light emitted by the phosphor at low angles of incidence.

Figure 4:
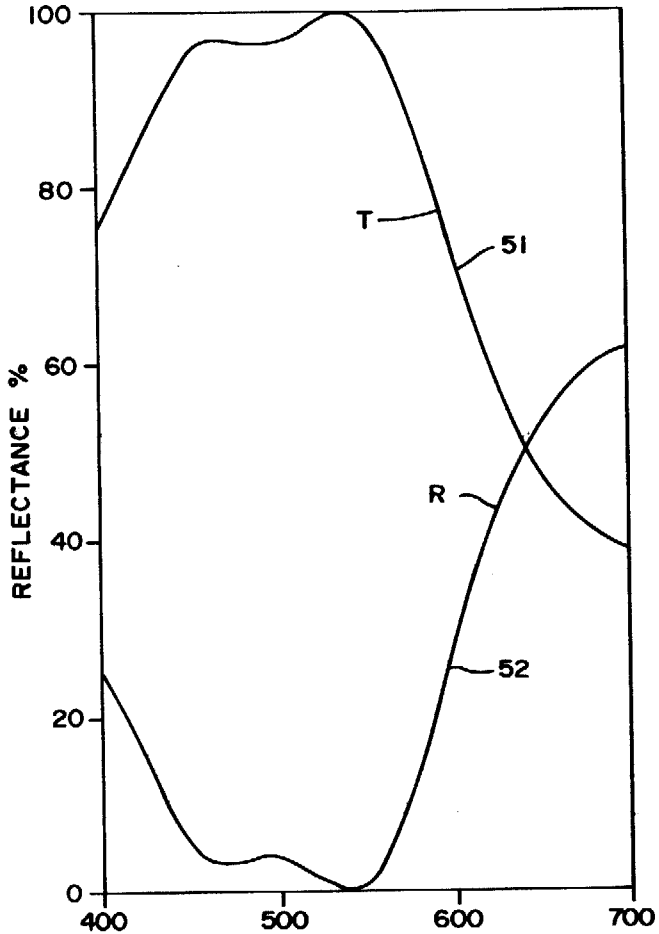
FIG. 4 is a graph showing the calculated performance of an angle sensitive shortwave pass filter.

Layers 6 through 10 of the filter design shown in Table I comprise a short wave pass filter which has significant change of performance as the angle of incidence is increased away from normal incidence. As can be seen, the short wave pass filter is formed of fused silica and titanium dioxide layers having specified physical thicknesses. The calculated performance of such a short wave pass filter is shown in FIG. 4 in which the transmission is given by the curve 51 and the reflectance is given by the curve 52.

A fluorescent phosphor screen 48 is deposited over the angle sensitive short wave pass filter. An optional metallized coating 49 overlies the phosphor screen. Both the phosphor screen and the metallized coating are of the type hereinbefore described.

Figure 5:
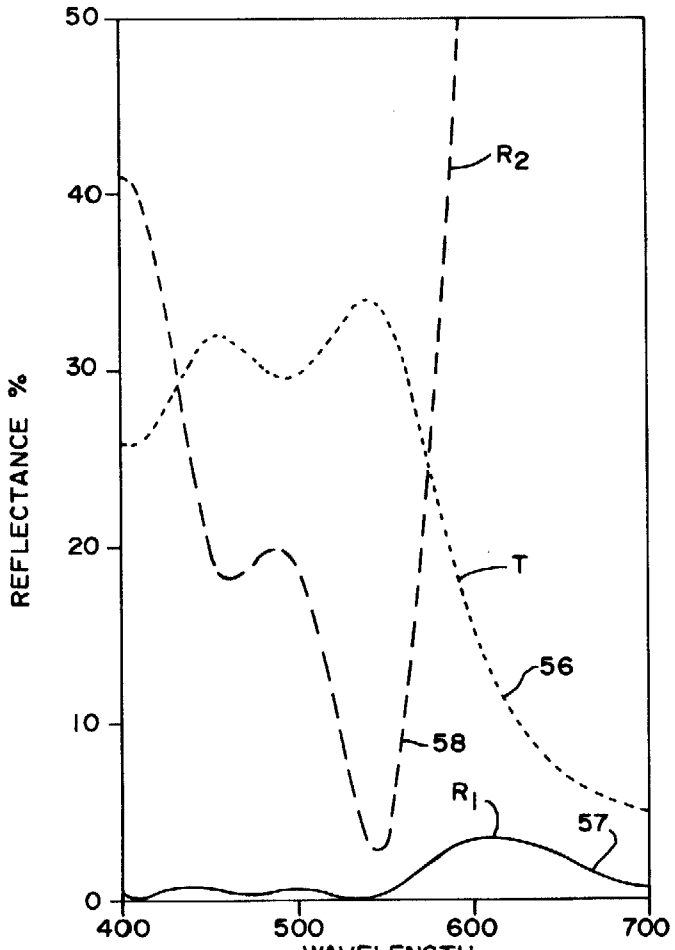
FIG. 5 is a graph showing the calculated performance of a combination absorbing filter and angle sensitive shortwave pass filter utilized as interior coating on a cathode ray tube incorporating the present invention.

The calculated performance for the ten layer filter design as shown in Table I is shown by the curves in FIG. 5. Thus, the curve 56 shows the transmission for the combined filter whereas the curve 57 represents the reflectance of the filter when viewed by an observer and the curve 58 is the reflectance from the phosphor side of the face plate.

From FIG. 5 it can be seen that by combining the absorbing filter with the angle sensitive short wave pass filter, a combined effect from both filters is obtained.

The light that is emitted from the phosphor at high angles is principally reflected by the short wave pass filter. In order to limit the cost of the short wave pass filter and to make it easily producible, the number of layers of the short wave pass filter has been limited as, for example, the six layers shown in Table I so that it is not 100 percent efficient. This means that some small amount of high angle light (less than 41° from a line perpendicular to the inner surface of the face plate) will leak through the short wave pass filter. Such light which does leak through the short wave pass filter must pass through the absorbing filter section 46 where it is further attenuated. What little light that gets through the absorbing filter during its first pass will be reflected off the surface 43 after which it must pass down through the absorbing filter 46 where it is attenuated again. However, since this light is still at a relatively high angle, what little light remains will be reflected by the short wave pass filter and bounced out of the system. Thus, it can be seen that by adding a very few layers to the absorbing filter, a much improved performance can be obtained over that which is provided by just a short wave pass filter by itself. In addition, the absorbing filter reduces scattered white light. It helps to eliminate the halo and it also increases the contrast of the final display.

Unexpected results were obtained with the combination of the absorbing filter with the angle sensitive short wave pass filter. Normally, one skilled in the art would expect to obtain fairly high reflection off the short wave pass filter from the observer's side. The results from the combined filter show there is, in fact, less specular reflection than one would expect from combining a normal absorbing filter with the short wave pass filter. By way of example, one would expect to obtain 4 to 5% reflection from such a combination when, in fact, a reflection as low as 2% was achieved, which is a factor of two less than expected. This is an important feature for the present invention, particularly in areas in which the cathode ray tube is to be viewed where there is high illumination.

Although it is no longer critical, it still may be desirable to provide an anti-reflection coating 61 on the outer front surface 42 of the face plate 41. As explained above, an anti-reflection coating of the type described in the U.S. Pat. No. 3,185,020 can be utilized.

The arrangement shown in FIG. 2 in which the absorption filter is placed between the observer and the short wave pass filter has the advantage in that the short wave pass filter which reflects light that used to form the halo is now reflected back onto the phosphor grains and gives increased spot brightness. This spot brightness is achieved even though there is some attenuation of the light by the absorption filter. By combining the absorbing filter with the short wave pass filter, the attenuation of the absorbing filter of the desired high angle signal light rays is negligible.

The filter which is shown in FIG. 1 was designed for phosphor which emits at approximately 525 nanometers. Thus, as shown in FIG. 5, the transmissivity at approximately 520 nonometers is approximately 30%. The reflectance from the observer's side as represented by the curve 57 is almost zero. The reflectance from the inside or phosphor side is in the order of 10% less, as shown by the curve 58. As can be appreciated with the present invention, at normal incidence it is important to have low reflectance so that the transmission can be quite high. As pointed out in the co-pending application, Ser. No. 036,324, filed May 7, 1979, when the same curves are calculated at an angle because of the angle sensitivity of the short wave pass filter, the reflection curve goes to much higher values at the shorter wave lengths which provides the angle sensitivity hereinbefore described.

In Table II there is shown a short wave pass filter plus an absorbing filter design comprised of eight layers in which 50% nominal transmission in the layers 1 and 2 form the absorbing layers formed of molybdenum and fused silica respectively and wherein a short wave pass filter is formed of layers 3 through 8 formed of titanium dioxide and fused silica.

In making absorbing and angle sensitive short wave pass filters in accordance with the present invention, it was found that the measured performance was very close to the calculated performance shown in the curves hereinbefore described.

Figure 6:
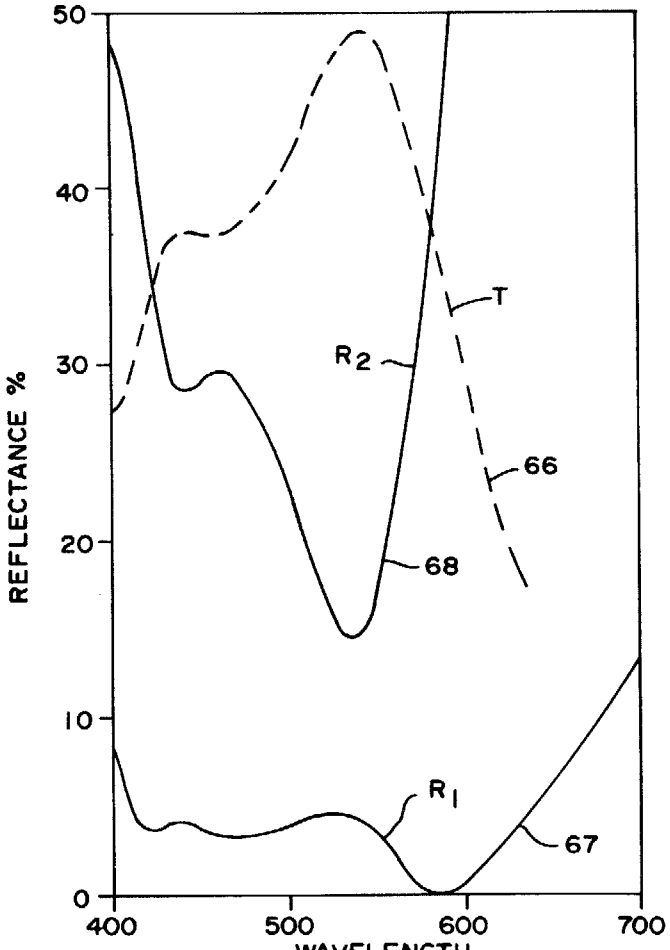
FIG. 6 is a graph showing the calculated single surface reflectance and transmittance of a 50% transmission design incorporating the present invention.

The calculated single surface reflectance and transmittance of a 50% transmission design is shown in FIG. 6 in which the curve 66 represents the transmittance, curve 67 represents the reflectance from the observer side and curve 68 represents the reflectance from the phosphor side. As can be seen, the reflectivity from the outer or observer side is slightly greater than for 30% transmission which is caused by a little lower attenuation of the reflectance from the short wave pass filter. Again, filters constructed in this manner had measured reflectances which agreed substantially with the calculated reflectances.

From the foregoing it can be seen that there has been provided a new and improved face plate construction which uses an absorbing filter by itself or the combination of an absorbing filter with an angle sensitive short wave pass filter to substantially attenuate the formation of a halo on the face plate. There is unrestricted viewing of the graticule since the filter is applied behind the graticule as seen by the observer. Further, the graticule can be edge lighted uniformly over the entire surface area. The reflectance from the observer side of the phosphor glass interface can be made low for much larger angular ranges when absorbing material is used. With the filter construction herein described, the layers of the absorbing filter and the layers of the short wave pass filter can be deposited in the same vacuum. There are no additional surfaces which can reflect light towards the observer or which need to be anti-reflection coated. The filter of the present invention is protected since it is within the envelope of the cathode ray tube and thus is immune to optical degradation. In addition, it is immune to scratching which could be due to mishandling or improper cleaning techniques.

Because the light which forms the halo must pass three times through the absorbing filter while the signal light passes through the absorbing filter only once, the filter of the present invention selectively attenuates the halo.

In the present invention, the background color of the screen can be adjusted to give a pleasing tint or to enhance the color contrast of the display.

The reason that the combined short wave pass and absorbing filters is more effective than the short wave pass filter alone in decreasing the intensity of the halo is that the light emitted at high angles by the excited phosphor grains which is not reflected by the SWP filter is absorbed by the absorbing filter rather than being reflected back to the phosphor by the first surface to cause the halo.

The reason that the combined SWP and absorbing filters is more effective than the absorbing filter alone in decreasing the intensity of the halo is that the light emitted at high angles by the excited phosphor grains is reflected back into the phosphor screen, thereby increasing the brightness of the central spot. Relatively high absorption levels would be required in the absorbing filter to eliminate the halo in the absence of the SWP filter.

From the foregoing it can be seen that an absorbing reflecting coating can be utilized to reduce the halo effect while increasing the contrast of the cathode ray tube display. Only a small penalty in the intensity of the display need be incurred and part of this loss may be recovered by the improvement in the efficiency of the spot from the light reflected back from the halo reducing angle sensitive short wave pass filter.

What is claimed is:

1. In a cathode ray tube face plate construction for suppressing the halo on the face plate of the cathode ray tube, a face plate formed of glass having an index of refraction in the range of 1.45 to 1.75 and having outer and inner surfaces, a fluorescent phosphor screen carried by the inner surface, and an absorbing filter carried by the inner surface of the face plate disposed between the phosphor screen and the inner surface of the face plate, said absorbing filter being comprised of a plurality of metal dielectric periods, each period being comprised of two layers with one of the layers being formed of a dielectric and with the other of the layers being formed of a metal.

2. In a cathode ray tube face plate construction for suppressing the halo on the face plate of the cathode ray tube, a face plate formed of glass having an index of refraction in the range of 1.45 to 1.75 and having outer and inner surfaces, a fluorescent phosphor screen carried by the inner surface, a light absorbing filter carried by the inner surface of the face plate disposed between the phosphor screen and the inner surface of the face plate, said absorbing filter being comprised of two metal-dielectric periods, each period being comprised of two layers with one of the layers being formed of a dielectric and with the other of the layers being formed of a metal, a metallic coating overlying the phosphor screen on the side of the screen facing away from the face plate, and an anti-reflection coating carried by the outer surface of the face plate to reduce reflection from the outer surface of the face plate.

3. In a cathode ray tube face plate construction for suppressing the halo on the face plate of the cathode ray tube, a face plate formed of glass having an index of refraction in the range of 1.45 to 1.75 and having outer and inner surfaces, a fluorescent phosphor screen carried by the inner surface, and an absorbing filter carried by the inner surface of the face plate disposed between the phosphor screen and the inner surface of the face plate, said absorbing filter being comprised of at least two layers and one of the layers being formed of a dielectric and the other of the layers being formed of a metal, said dielectric being fused silica and said metal being selected from nickel, chrome, a nickel chrome alloy, molybdenum and a nickel, chrome and iron alloy.

4. A construction as in claim 1 wherein the metal layer of the absorbing filter has an index of refraction selected in the ratio of 0.7 to 3.0 where the ratio is determined by k/n where k is an imaginary component and n is the real component.

5. A construction as in claim 1 wherein the dielectric material has an index of refraction ranging from 1.35 to 1.70.

6. In a cathode ray tube face plate construction for suppressing the halo on the face plate of the cathode ray tube, a face plate formed of glass having an index of refraction in the range of 1.45 to 1.75 and having outer and inner surfaces, a fluorescent phosphor screen carried by the inner surface, an absorbing filter carried by the inner surface of the face plate disposed between the phosphor screen and the inner surface of the face plate, said absorbing filter being comprised of at least two layers and one of the layers being formed of a dielectric and the other of the layers being formed of a metal and an angle sensitive short wave pass filter disposed between the phosphor screen and the absorbing filter, said short wave pass filter having a low reflectance for light emitted by the phosphor at near normal angles of incidence and high reflectance at high angles of incidence.

7. A construction as in claim 6 wherein said high angle of incidence approximates the critical angle inside the faceplate.

8. A construction as in claim 6 wherein the said short wave pass filter is formed a plurality of layers with relatively higher and relatively lower indices of refraction.

9. A construction as in claim 8 wherein the said higher index material is titanium dioxide.

10. A construction as in claim 8 wherein the said higher index material is tantalum pentoxide.

11. A construction as in claim 8 wherein the said lower index material is fused silica.

12. A construction as in claim 6 wherein said absorbing filter and short wave pass filter are immediately adjacent to each other.

13. In a method for suppressing the halo on the face plate of a cathode ray tube in which the face plate is formed of glass having outer and inner surfaces and a fluorescent phosphor screen, suppressing the central portion of the halo by placing an anti-reflection coating on the outer surface of the face plate and suppressing the outer ring-like portion of the halo by placing an absorbing filter comprising at least two metal-dielectric periods on the inner surface of the face plate and causing the light which normally forms the halo on the face plate to pass repeatedly through said absorbing filter to selectively attenuate the light creating the halo with respect to light creating the display on the face plate.

14. A method as in claim 13 wherein the light creating the halo passes through the absorbing filter at least three times.

15. A method as in claim 14 together with the step of reflecting the light having a high angle of incidence emitted by the phosphor.

* * * * *